US008328316B2

(12) United States Patent
Tanaka

(10) Patent No.: US 8,328,316 B2
(45) Date of Patent: Dec. 11, 2012

(54) INKJET PRINTHEAD, PRINTING APPARATUS, AND PRINTING METHOD

(75) Inventor: Souhei Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 123 days.

(21) Appl. No.: 12/907,387

(22) Filed: Oct. 19, 2010

(65) Prior Publication Data

US 2011/0096116 A1 Apr. 28, 2011

(30) Foreign Application Priority Data

Oct. 26, 2009 (JP) ..... 2009-245930

(51) Int. Cl.
*B41J 29/38* (2006.01)
*B41J 29/393* (2006.01)

(52) U.S. Cl. ..... 347/14; 347/9; 347/19

(58) Field of Classification Search ..... None
See application file for complete search history.

(56) References Cited

U.S. PATENT DOCUMENTS 5,861,895 A 1/1999 Tajika et al.
5,894,314 A 4/1999 Tajika et al.
6,027,198 A 2/2000 Tanaka et al.
6,102,510 A * 8/2000 Kikuta et al. ..... 347/9
6,116,710 A 9/2000 Tajika et al.
6,310,636 B1 * 10/2001 Tajika et al. ..... 347/14
6,457,794 B1 10/2002 Tajika et al.
6,789,865 B2 9/2004 Suzuki et al.
6,896,345 B2 5/2005 Nakayama et al.
6,913,337 B2 7/2005 Kuronuma et al.
7,284,811 B2 10/2007 Tanaka et al.
7,556,330 B2 7/2009 Saito et al.
2008/0007782 A1 1/2008 Tanaka et al.

FOREIGN PATENT DOCUMENTS

JP 2002-103586 A 4/2002

* cited by examiner

*Primary Examiner* — Geoffrey Mruk
*Assistant Examiner* — Bradley Thies
(74) *Attorney, Agent, or Firm* — Fitzpatrick, Cella, Harper & Scinto

(57) ABSTRACT

This invention is directed to provide an inkjet printhead, printing apparatus, and printing method capable of correcting a shift of the printing position caused by variations of the discharge characteristic between nozzles. To accomplish this, the inkjet printhead includes memories which hold block numbers used to time-divisionally drive nozzles. The block numbers are written in consideration of the discharge characteristics of the printhead during the manufacturing process of the printhead. When the inkjet printhead is mounted in the printing apparatus, the printing apparatus reads out block numbers corresponding to respective nozzles from the memories. Based on the numbers, the printing apparatus changes block selection signals for the respective nozzles, and transfers the changed block selection signals to the inkjet printhead to drive it.

6 Claims, 8 Drawing Sheets

PRIOR ART

PRIOR ART

INKJET PRINTHEAD, PRINTING APPARATUS, AND PRINTING METHOD

BACKGROUND OF THE INVENTION

1. Field of the Invention

The present invention relates to an inkjet printhead, printing apparatus, and printing method. Particularly, the present invention relates to an inkjet printing apparatus which prints by scanning, on a printing medium in a direction perpendicular to the nozzle array direction, a printhead having a plurality of nozzles that are arrayed in a predetermined direction and discharge ink droplets, and a method of driving the printhead of the apparatus.

2. Description of the Related Art

Printers with printing information such as a text or image which a user wants on a printing medium such as paper or a film, have conventionally been known as information output apparatuses in a wordprocessor, personal computer, facsimile machine, and the like. As the printing method of such a printer, various methods are known, including dot impact printing, thermal printing, and inkjet printing. Of these methods, the inkjet printing method is one of the non-impact printing methods, and is advantageous because it can print on a variety of printing media at high speed, and can fix an image even on so-called plain paper without any special processing and provide a high-resolution image at low cost.

With these advantages, inkjet printing apparatuses are rapidly prevailing recently, not only as a printer serving as a peripheral device of a computer, but also as printing apparatuses in a copying machine, facsimile machine, wordprocessor, and the like.

Inkjet types in ink discharge methods widely used at present are classified into a method using an electrothermal transducer (heater), and one using a piezoelectric element. Either method controls discharge of ink droplets using an electrical signal. According to an ink droplet discharge principle using the electrothermal transducer, an electrical signal is supplied to the electrothermal transducer to instantaneously boil ink near the electrothermal transducer (film boiling). An ink droplet is quickly discharged by rapid growth of a bubble generated by phase change of ink at this time. Therefore, this method has advantages of simplifying the structure of the inkjet printhead (to be referred to as a printhead), and easily integrating nozzles.

For high-density printing, the printhead often has a plurality of nozzles for discharging ink, and a plurality of discharge pressure generation elements. In general, the printhead adopts a time-divisional driving method. More specifically, according to this method, the nozzles are divided into a plurality of groups for every predetermined number of nozzles based on physical positions. The nozzles in each group are further divided into driving blocks. The discharge pressure generation elements are time-divisionally driven for each driving block. The divisional driving method is effective for downsizing power supply members such as a head driving power supply, connector, and cable.

Especially in a printhead using heaters, it is necessary to minimize voltage fluctuations and finely adjust the voltage value in order to perform stable discharge in consideration of the characteristics of the heater, ink, and the like. It is not preferable to increase the capacity of the power supply for the discharge pressure generation element. The divisional driving method is effective even for satisfying these requirements concerning the power supply.

An outline of a printing method on a printing medium by an inkjet printing apparatus will be explained.

FIG. 6 is a schematic view showing flying of ink droplets discharged from the printhead.

In a printhead of this example, as shown in a of FIG. 6, a nozzle array 101 has 48 nozzles. The nozzles are divided into six, first to sixth groups, and each group includes eight nozzles. Nozzle numbers 1 to 48 are assigned to the respective nozzles.

As shown in b of FIG. 6, this printhead has eight time-divisional driving blocks such that six nozzles having nozzle numbers 1, 9, 17, 25, 33, and 41 belong to the 0th block, and nozzles having nozzle numbers 2, 10, 18, 26, 34, and 42 belong to the first block. All the nozzles are sequentially driven at eight different timings of a period T in ascending order of the 0th to seventh blocks sequentially in accordance with pulse-like discharge timing signals 301-0 to 301-7 shown in b of FIG. 6. In this way, the plurality of nozzles are time-divisionally driven. In other words, each of the eight nozzles in each group belongs to one of the eight blocks, and upon printing, the nozzles are time-divisionally driven for the respective blocks. That is, nozzles in the same block are concurrently driven. Note that each of numbers "0" to "7" is a value indicating a block (block number).

In the example of FIG. 6, each nozzle discharges an ink droplet 302 to a printing medium 13 in correspondence with a driving signal, as shown in c of FIG. 6. Note that the discharge period T of each nozzle is determined based on position information generated by reading a scale arranged along the carriage moving path by an encoder along with movement of the carriage of the inkjet printing apparatus, and processing the reading signal by the CPU.

FIG. 7 is a block diagram showing the circuit arrangement of the printhead and the arrangement of the print data generator of the inkjet printing apparatus.

A printhead 102 includes 48 heaters 501-1 to 501-48 in correspondence with 48 nozzles. The respective heaters are connected to a heater driving power supply VH, and drivers 502-1 to 502-48 for driving the corresponding heaters. The control input signals of the respective drivers are connected to independent gates 503-1 to 503-48, respectively.

In addition, the input of each gate 503-xx (xx=1 to 48) is connected to a heat enable signal ENB, one of six data lines for respective nozzles, and one of eight driving block signal lines.

Each of the print data signals DATA serially transferred from the printing apparatus is received by a serial-parallel converter 504, and is latched by a latch 505 for each block in synchronism with the input timing of a latch signal LT. This operation is executed eight times, receiving print data signals DATA corresponding to all the 48 heaters of the printhead and supplying print data signals corresponding to sixth nozzles for each input. Since the driving block signal takes eight states of 0 to 7 in order to select one of the eight blocks, the printing apparatus serially transfers 3-bit signals. The 3-bit signal is latched by the latch 505 and converted into eight block selection signals by a decoder 506.

A print data generator 508 in the printing apparatus generates the heat enable signal ENB, the print data signal DATA, a clock signal CLK, and the latch signal LT used to drive the printhead. When a timing adjustment circuit 507 detects a change of a position signal from an encoder 12, the printhead 102 acquires from the print data generator 508, the print data signal DATA to be printed at this position. The print data generator 508 includes a buffer memory, which stores print data transferred from a host (not shown) via an interface (not shown) after converting the print data in the ink discharge order. The print data generator 508 receives even image data read by a scanner or the like.

The timing adjustment circuit 507 decomposes data for the 48 nozzles into data for six nozzles/eight blocks, and transfers the resultant data to a print data converter 509. The print data converter 509 converts data of six pixels (for six nozzles) and block number data into serial signals, and outputs them to the printhead 102.

Each nozzle has nozzle-specific characteristics regarding the ink droplet discharge direction, discharged liquid speed, and the like. The nozzle-specific characteristics may adversely affect a printed image and cause occurrence of a stripe, density unevenness, or the like in the printed image.

FIGS. 8A and 8B are, corresponding to nozzle arrangement shown in a of FIG. 6, views for explaining occurrence of a stripe, density unevenness, or the like in a printed image.

FIG. 8A shows printing positions on the printing medium 13, assuming that the nozzles have a uniform ink discharge characteristic (shift amount=0) and all the nozzles discharge ink at the different timings (DT0, DT1, . . . , DT7) of the period T described with reference to FIG. 6 along with a movement of the carriage. FIG. 8B is a view conceptually showing a shift of the printing position on the printing medium due to the discharge characteristic of each nozzle. For example, the printing position of a nozzle with a block number "0" in the first group shifts rightward in FIG. 8B by 1 when a distance corresponding to ⅛ of the resolution from the reference printing position is defined as unit "1". For example, a nozzle with a block number "1" in the first group prints at almost the same position as the reference printing position. Further, for example, the printing position of a nozzle with a block number "2" in the first group shifts leftward in FIG. 8B by 2 when a distance corresponding to ⅛ of the resolution from the reference printing position is defined as unit "1". In this fashion, the printing position shifts for each nozzle due to the nozzle characteristic. As a result, a stripe or density unevenness appears in a printed image.

To reduce the adverse effect on a printed image, multi-pass printing has been used to print an image by scanning a printing area by an inkjet printhead by a plurality of number of times so as to print the same raster using two or more different nozzles (for example, see Japanese Patent Laid-Open No. 2002-103586 (FIG. 1, paragraph [0018]).

However, multi-pass printing has a drawback of decreasing the printing speed because an area printable at once is restricted to, for example, ½ or ⅓ of the nozzle array. To make the stripe or density unevenness less conspicuous, the number of passes needs to be increased.

The inkjet printing apparatus is required to maintain a state in which ink can always be discharged stably. However, as the printing quality becomes higher, it becomes more difficult to suppress manufacturing variations of nozzles and variations of printing elements to a level at which they do not affect the quality of a printed image. Further, this raises the manufacturing cost.

SUMMARY OF THE INVENTION

Accordingly, the present invention is conceived as a response to the above-described disadvantages of the conventional art.

For example, an inkjet printhead, printing apparatus, and printing method according to this invention are capable of correcting a shift of the printing position caused by variations of the discharge characteristic between nozzles.

According to one aspect of the present invention, there is provided an inkjet printhead used to divide a plurality of heaters into a plurality of blocks, time-divisionally drive the heaters for the respective blocks, and print on a printing medium, the printhead comprising: a serial-parallel converter which receives print data signals and block selection signals serially transferred from a printing apparatus; a latch which latches the block selection signals; a plurality of memories which correspond to the respective heaters and store block numbers for driving the respective heaters according to time-divisional driving; a plurality of comparators which are arranged in correspondence with the respective heaters, receive the block selection signals latched by the latch and the block numbers stored in the plurality of memories, and compare values of the block selection signals and values of the block numbers; and a plurality of drivers which are arranged in correspondence with the respective heaters, and drive the respective heaters in accordance with comparison results of the plurality of comparators.

According to another aspect of the present invention, there is provided a printing apparatus, to which the above-mentioned inkjet printhead is mounted, for printing by discharging ink droplets from the inkjet printhead, the apparatus comprising: a read-only circuit which reads out block numbers corresponding to the respective heaters from the plurality of memories; a print data generator which generates print data signals and block selection signals to be supplied to the inkjet printhead; and a timing adjustment circuit which adjusts transfer timings of the print data signals and block selection signals to the inkjet printhead, based on the block numbers read out by the read-only circuit.

According to still another aspect of the present invention, there is provided a method of printing by discharging ink droplets from the above-mentioned inkjet printhead, the method comprising: reading out block numbers corresponding to the respective heaters from the plurality of memories; generating print data signals and block selection signals to be supplied to the inkjet printhead; and adjusting transfer timings of the print data signals and block selection signals to the inkjet printhead, based on the read out block numbers.

According to still another aspect of the present invention, there is provided an inkjet printhead used to print on a printing medium by driving a plurality of heaters at one of a first timing and second timing, the printhead comprising: a serial-parallel converter which receives print data signals, a first timing signal and a second timing signal serially transferred from a printing apparatus; a latch which latches the first and second timing signals; a plurality of memories which correspond to the respective heaters and store information on driving timings assigned to the respective heaters for driving the respective heaters; a plurality of comparators which are arranged in correspondence with the respective heaters, receive the first and second timing signals latched by the latch and the information stored in the plurality of memories, and compare values of the first and second timing signals and the information; and a plurality of drivers which are arranged in correspondence with the respective heaters, and drive the respective heaters in accordance with comparison results of the plurality of comparators.

The invention is particularly advantageous since block numbers determined in consideration of the ink discharge characteristics of each inkjet printhead are stored in memories, and in the printing operation, information in the memory can be read out to change the block selection timing in time-divisional driving. As a result, the ink discharge timing changes, and the printing position on the printing medium can be corrected. In this way, high printing quality and high printing speed can be achieved at low cost without using a complicated printing method such as multi-pass printing or a complicated circuit or control.

Further features of the present invention will become apparent from the following description of exemplary embodiments (with reference to the attached drawings).

DESCRIPTION OF THE EMBODIMENTS

An exemplary embodiment of the present invention will now be described in detail in accordance with the accompanying drawings. Note that arrangements disclosed in the following embodiments are merely illustrative, and the present invention is not limited to the illustrated arrangements.

A method of time-divisionally driving an inkjet printhead (to be referred to as a printhead) to form an image on a printing medium will be described in more detail with reference to the accompanying drawings.

Figure 1:
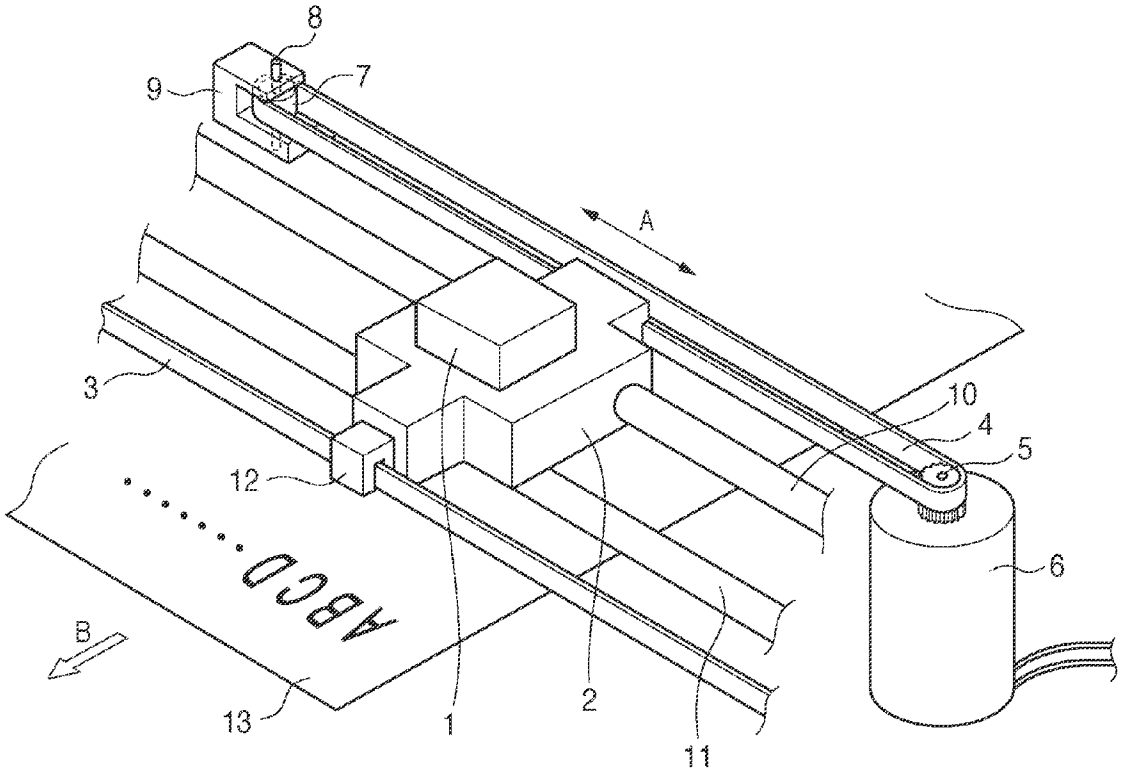
FIG. 1 is a perspective view of the main part of an inkjet printing apparatus as a typical embodiment of the present invention.

FIG. 1 is a perspective view showing the structure of the main part of an inkjet printing apparatus (to be referred to as a printing apparatus).

The printing apparatus shown in FIG. 1 repeats reciprocal movement of the printhead, and conveyance of a printing medium 13 at a predetermined pitch. In synchronism with these operations, the printing apparatus selectively discharges ink from the printhead, and fixes it to the printing medium 13, forming a text, symbol, image, or the like.

Figure 2:
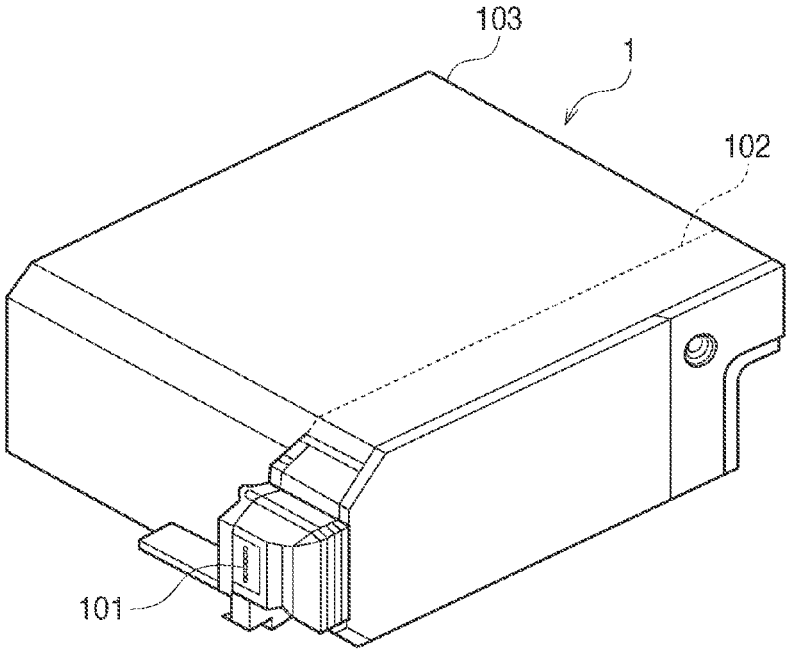
FIG. 2 is a perspective view of a cartridge which is mounted in the printing apparatus shown in FIG. 1 and has an inkjet printhead.

FIG. 2 is a perspective view showing a head cartridge 1 which is mounted in the printing apparatus shown in FIG. 1 and formed from a printhead 102 having a nozzle array 101 for discharging ink, and an ink tank 103. In the head cartridge 1, ink supplied from the ink tank 103 is heated by thermal energy generated by a heater arranged in correspondence with each nozzle, and is discharged from the nozzle of the printhead 102 by bubbling energy generated as a result of heating.

As shown in FIG. 1, the head cartridge 1 is detachably mounted on a carriage 2. A part of the carriage 2 is fixed to a timing belt 4 which is looped between a driving pulley 5 coupled to a DC motor 6, and an idler pulley 7. The carriage 2 can reciprocate in a direction indicated by arrow A along two guide shafts 10 and 11 as the DC motor 6 rotates. The carriage 2 includes an encoder 12 for reading position information of an encoder film 3. The idler pulley 7 is supported by a pulley shaft 8. A holder 9 which fixes the pulley shaft 8 is fixed to a chassis (not shown) to apply a predetermined tension to the timing belt 4.

An outline of driving control of the carriage 2 will be explained.

When the CPU (not shown) of the printing apparatus sends a control signal to a motor driving circuit (not shown), the motor driving circuit sends it to the DC motor 6. In accordance with the control signal, the DC motor 6 rotates. The encoder 12 mounted on the carriage 2 reads position information of the encoder film 3 as position information of the carriage 2, and transmits the information to the CPU. Based on this information, the CPU controls the position and speed of the carriage 2.

The printing medium 13 is conveyed by a conveyance roller (not shown) in a direction (for example, direction indicated by arrow B) perpendicular to the moving direction of the carriage 2 so as to face the ink discharge surface of the printhead 102 and maintain a predetermined distance from the ink discharge surface. Printing is performed by discharging ink at a predetermined position from the orifices of the printhead while moving the carriage 2 in the direction A with respect to the printing medium 13 conveyed to the printing area.

Two embodiments using a printing apparatus and head cartridge having structures as shown in FIGS. 1 and 2 will be explained.

First Embodiment

Figure 3:
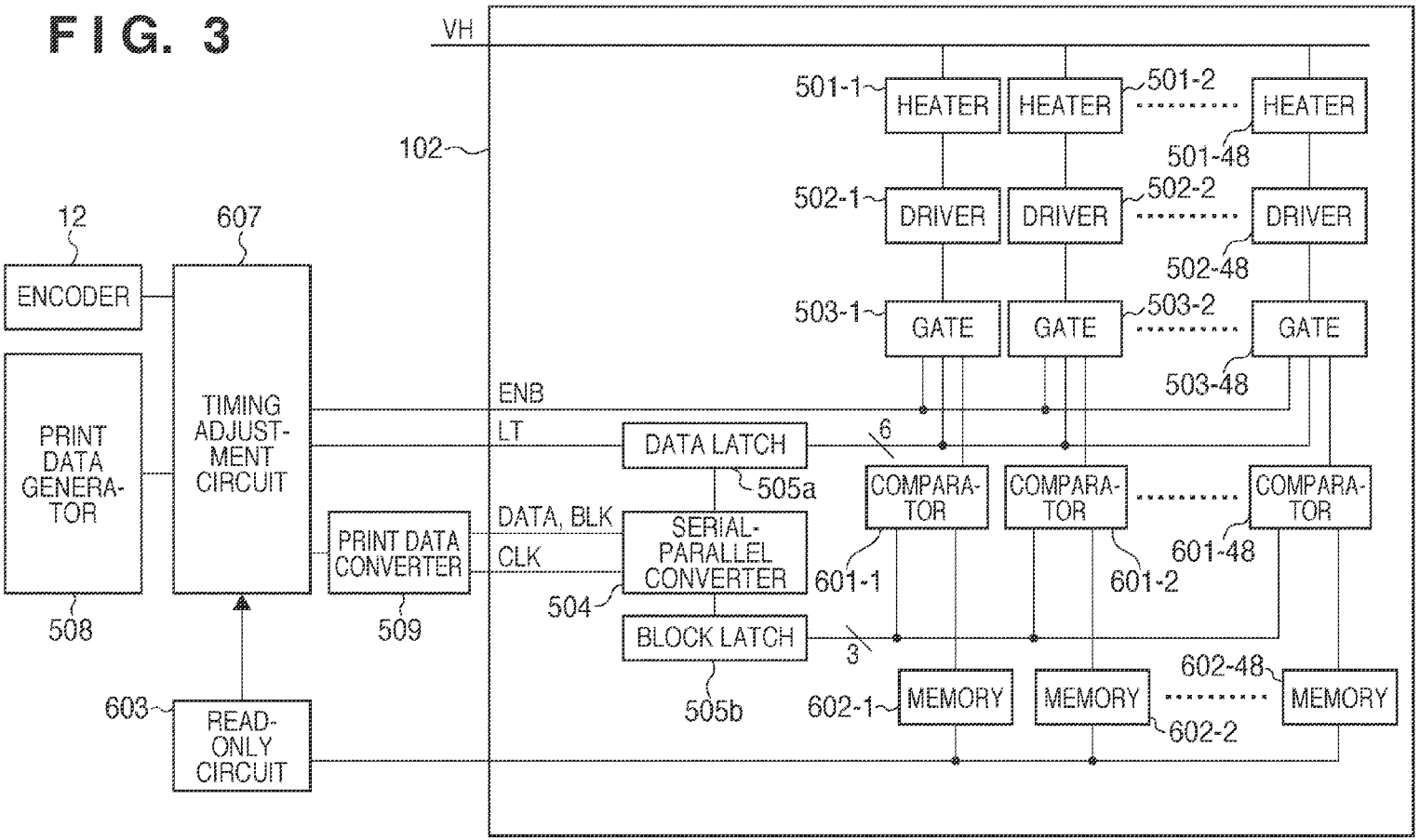
FIG. 3 is a block diagram showing the arrangement of a printhead and that of a control circuit in a printing apparatus concerning ink discharge according to the first embodiment.
Figure 6:
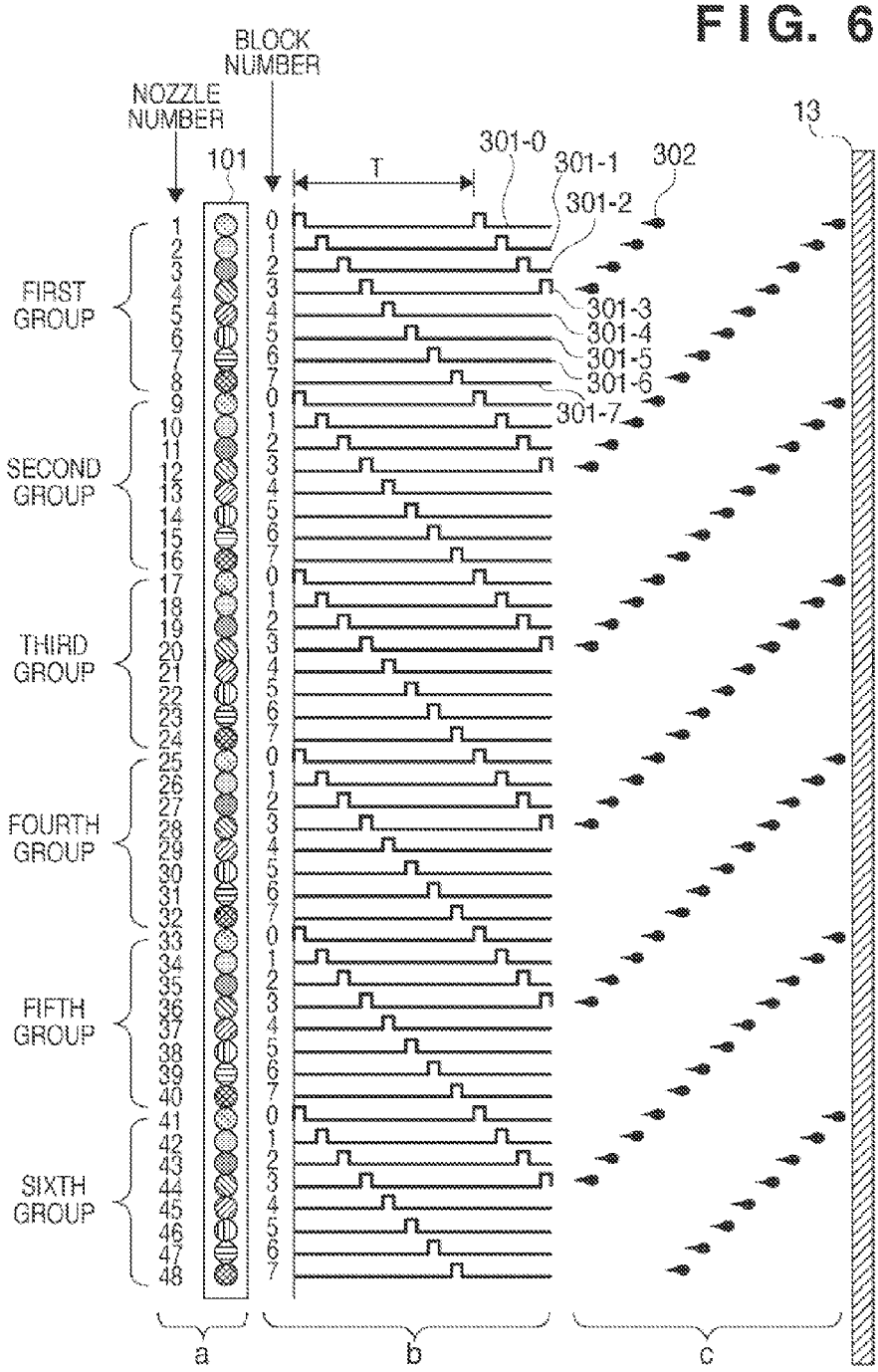
FIG. 6 is a schematic view showing flying of ink droplets discharged from a printhead.
Figure 7:
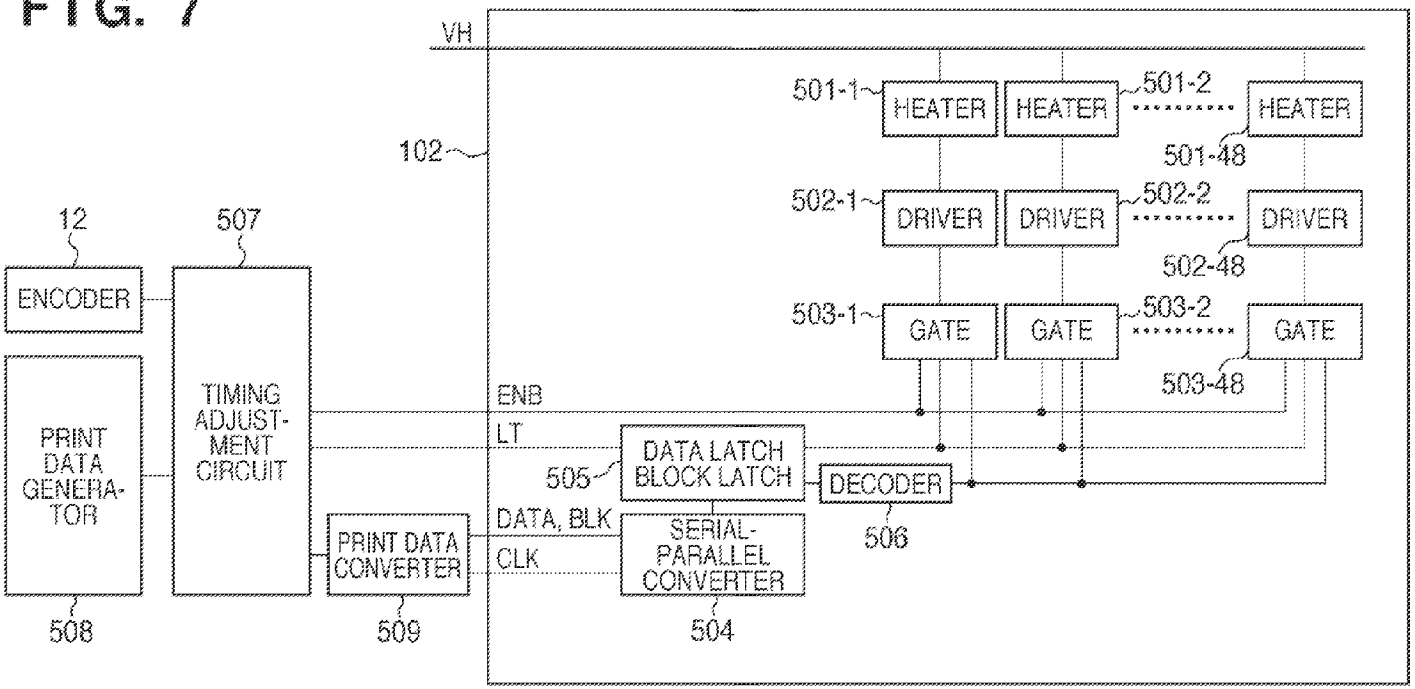
FIG. 7 is a block diagram showing the circuit arrangement of a conventional printhead and the arrangement of the print data generator of a conventional inkjet printing apparatus.

FIG. 3 is a block diagram showing the circuit arrangement of a printhead and the arrangement of the print data generator of a printing apparatus according to the first embodiment. In FIG. 3, the same reference numerals as those in the conventional arrangement shown in FIG. 7 denote the same parts, and a description thereof will not be repeated. Only an arrangement and operation unique to the first embodiment will be described. A printhead 102 includes a plurality of (48) nozzles, and 48 heaters are arranged in correspondence with the respective nozzles. As shown in b of FIG. 6, the 48 heaters are divided into six groups each having eight heaters. Eight time-divisional blocks, each including six (6) concurrently driven heaters, each taken from the respective groups, are formed. The printhead 102 includes 48 drivers 502-1 to 502-48 for driving 48 heaters 501-1 to 501-48. In this manner, the heaters in the respective blocks are time-divisionally driven.

As shown in FIG. 3, 48 comparators 601-1 to 601-48 are arranged in correspondence with 48 gates 503-1 to 503-48. An output from each comparator serves as one of input signals to each gate 503. A 6-bit print data signal line (data bus) is connected to each of 48 gates 503-1 to 503-48 from a data latch 505*a*. A 3-bit signal line is connected to each of 48 comparators 601-1 to 601-48 from a block latch 505*b*. The 3-bit signal supplies information indicating a block number. Memories 602-1 to 602-48 are arranged in correspondence with the respective comparators. Each of the memories 602-1 to 602-48 stores a block number corresponding to each nozzle. The 48 comparators receive block numbers from corresponding memories, and block selection signals BLK which are serially transferred from the printing apparatus, received by a serial-parallel converter 504, and latched by the block latch 505*b*. The block number stored in the memory takes a value of 0 to 7, and the block selection signal BLK transferred from the printing apparatus also takes a value of 0 to 7.

At the timing when a block number stored in the memory 602 in correspondence with each nozzle matches the value of the transferred block selection signal, the nozzle discharges ink according to values latched in the data latch 505*a*.

The printing apparatus includes a read-only circuit 603 which reads out all pieces of information from the memories 602-1 to 602-48 of the printhead 102. Based on the information read out from the memories, a timing adjustment circuit 607 generates 6-bit print data signals DATA and eight block selection signals BLK for time-divisionally driving the heaters of the printhead using print data signals corresponding to the 48 nozzles. Every time a new printhead 102 is mounted in the printing apparatus, new block numbers are read out from the memories of the printhead to change the timings of block numbers at which nozzles discharge ink. For this purpose, the timing adjustment circuit 607 changes the sequence of print data signals to be transferred to the printhead every time the printhead 102 is exchanged.

In the arrangement of the first embodiment, the ink discharge timings of the respective nozzles are changed by changing the generation timings of eight block selection signals. The printhead is mounted on the carriage and moves even during the printing operation. Hence, changing the ink discharge timing of each nozzle means changing the ink discharge position on the printing medium.

Figure 4A:
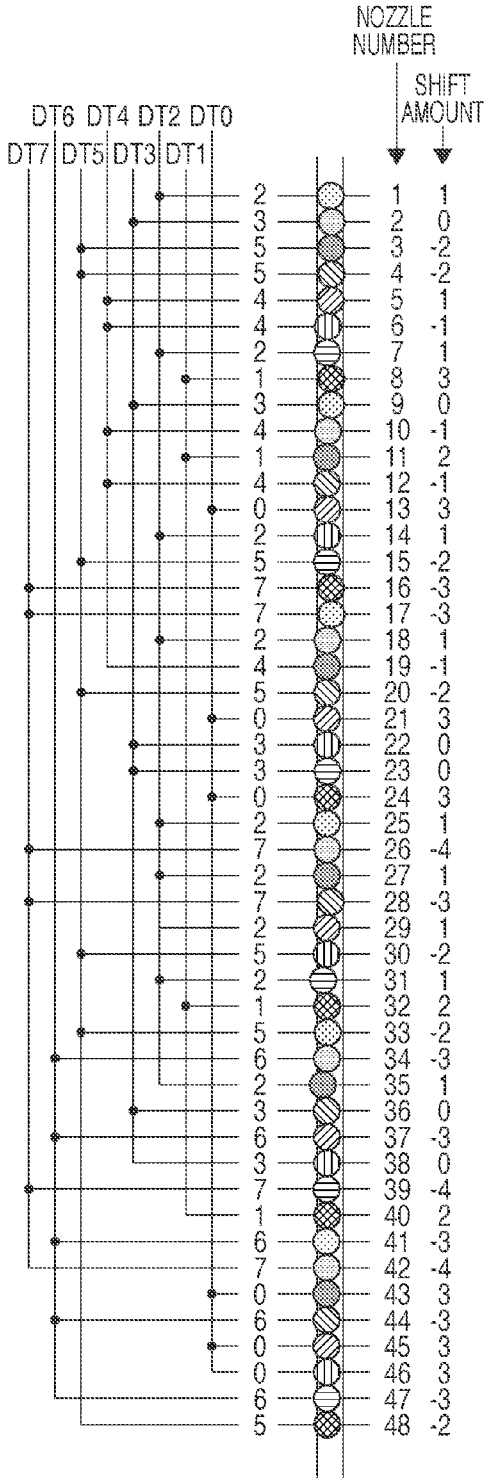
FIGS. 4A and 4B are views exemplifying corrections of the printing positions of ink droplets in time-divisional driving of the printhead according to the first embodiment.
Figure 4B:
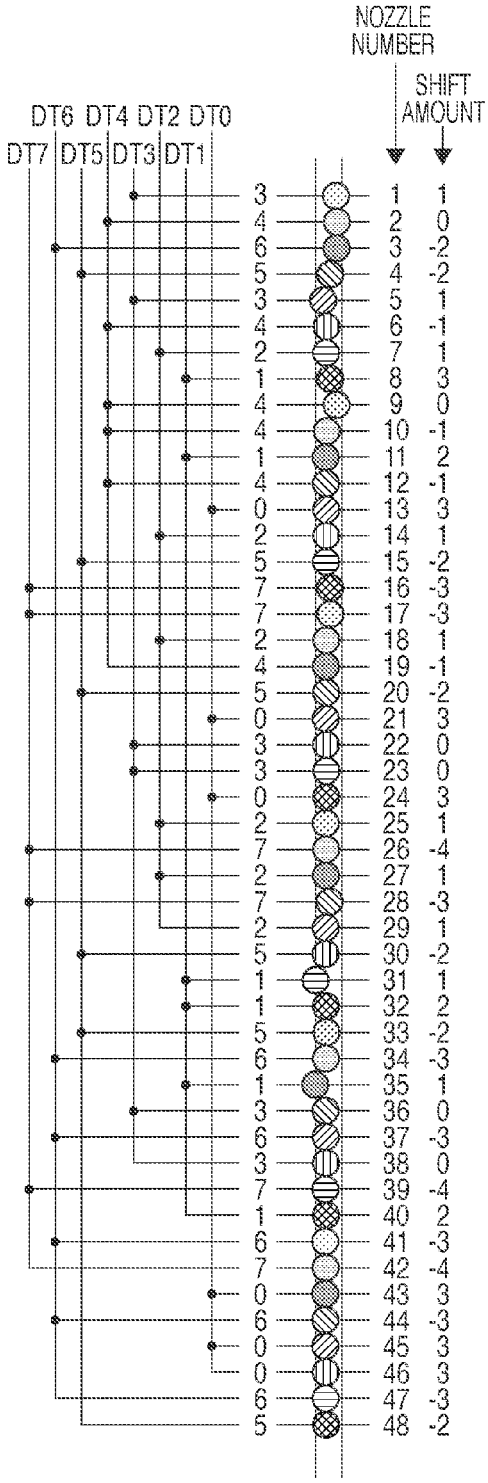

FIGS. 4A and 4B are views showing an example of determining a discharge block in accordance with the discharge characteristic of each nozzle. Note that nozzle arrangements in FIGS. 4A and 4B are the same as those in FIG. 6A.

Figure 8A:
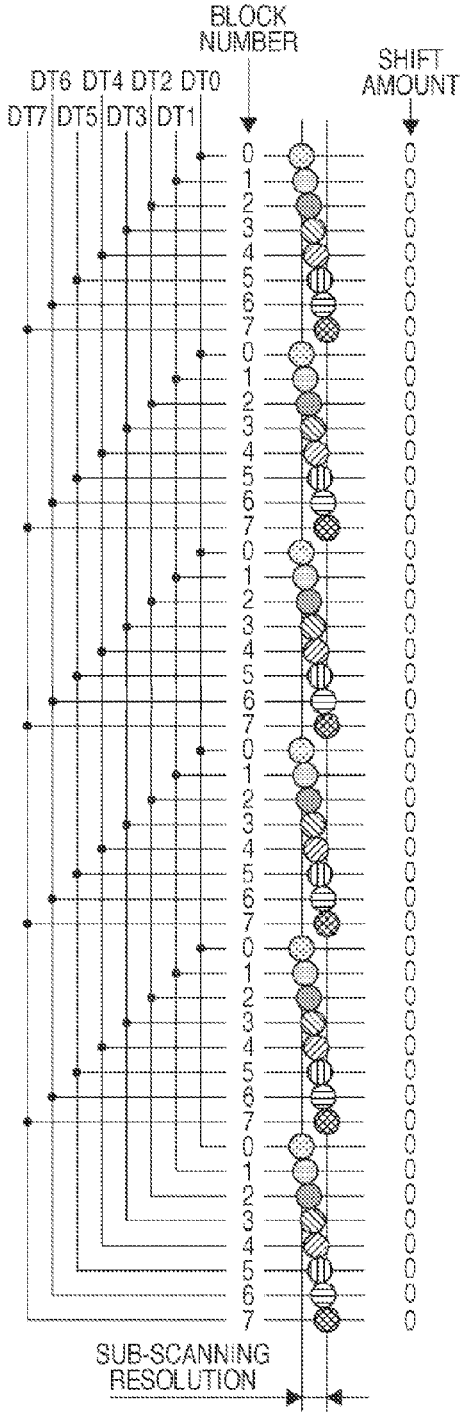
FIG. 8A PRIOR ART
FIGS. 8A and 8B are views for explaining occurrence of a stripe, density unevenness, or the like in a printed image.
Figure 8B:
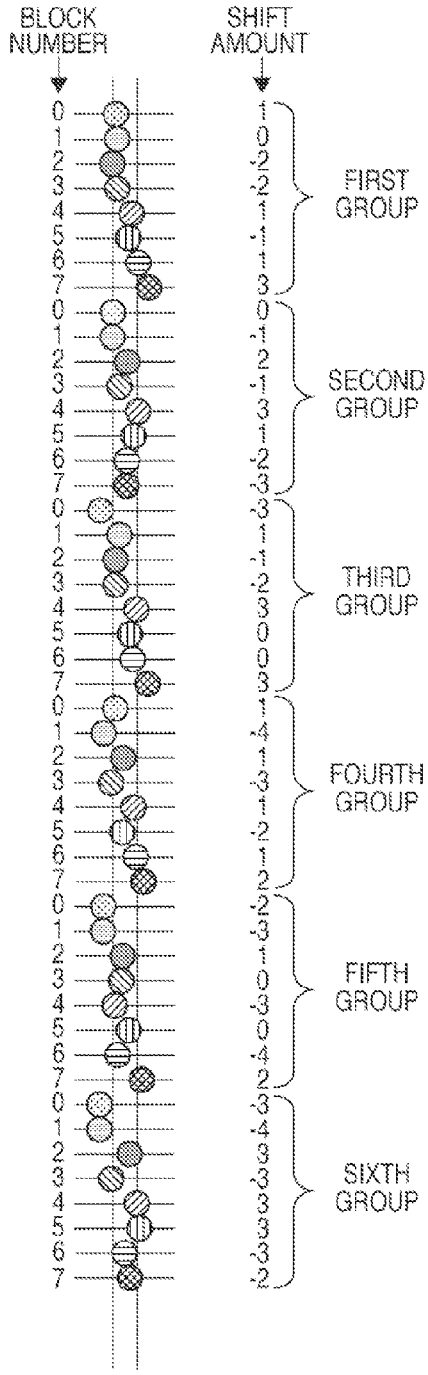
FIG. 8B PRIOR ART

FIG. 4A shows a printing position and timing assignment when nozzles are not evenly assigned to each block. FIG. 4B shows a printing position and timing assignment in a case where each of blocks contains nozzles of the same number. Discharge timings (DT0, DT1, . . . , DT7) in FIGS. 4A and 4B are assigned in consideration of the shift amounts shown in FIG. 8B.

FIG. 4A and FIG. 4B show block numbers stored in the memories when the printing positions of the 48 nozzles of the printhead shift from the reference by 1, 0, −2, −2, 1, −1, . . . , −3, 3, 3, −3, and −2 in order from the top nozzle. More specifically, block number 3 is assigned to a nozzle whose shift amount is "0". For each shift amount, block number 0 is assigned to a nozzle whose shift amount is "3", block number 1 is assigned to a nozzle whose shift amount is "2", and block number 2 is assigned to a nozzle whose shift amount is "1". As described above, block number 3 is assigned to a nozzle whose shift amount is "0". Further, block number 4 is assigned to a nozzle whose shift amount is "−1", block number 5 is assigned to a nozzle whose shift amount is "−2", block number 6 is assigned to a nozzle whose shift amount is "−3", and block number 7 is assigned to a nozzle whose shift amount is "−4". Since the shift characteristic is sometimes localized to a given shift amount, six nozzles are always assigned to each block. An example in FIG. 4A contains: seven (7) nozzles whose shift amount is "3"; three (3) nozzles whose shift amount is "2"; ten (10) nozzles whose shift amount is "1"; six (6) nozzles whose shift amount is "0"; four (4) nozzles whose shift amount is "−1"; seven (7) nozzles whose shift amount is "−2"; eight (8) nozzles whose shift amount is "−3"; and three (3) nozzles whose shift amount is "−4". On the other hand, as shown in FIG. 4B, all (48) nozzles are assigned such that nozzles of the same number are driven in a single timing. More specifically, as shown in an example of FIG. 4B, a nozzle with nozzle number 1 is assigned to a block with block number 3 although the shift amount is "1". A nozzle with nozzle number 2 is assigned to a block with block number 4 although the shift amount is "0". A nozzle with nozzle number 3 is assigned to a block with block number 6 although the shift amount is "−2". Note that this is merely illustrative. As far as nozzles of the same number are assigned to each block, various assignments are also possible. Note that the block number corresponds to a discharge timing to drive the nozzle. For example, a nozzle with block number 0 is driven at discharge timing 0, a nozzle with block number 1 is driven at discharge timing 1, and a nozzle with block number 7 is driven at discharge timing 7.

FIG. 4B shows the result of assigning block numbers in accordance with a shift of each nozzle. FIG. 4A shows a printing position in a case where there is no correction. If no correction is performed, printing positions become irregular, as shown in FIG. 4A. However, if correction is executed, ink droplets are printed at positions in almost the straight line, as shown in FIG. 4B. The timing adjustment circuit 507 assigns data to be transferred via the print data signal line in correspondence with assignment of the block numbers of FIG. 4B. For example, as shown in FIG. 4B, a 6-bit print data signal line is assigned to nozzles 1, 5, 22, 23, 36 and 38 with a discharge timing DT3. In other words, the first bit data, the second bit data, the third bit data, the fourth bit data, the fifth bit data and the six bit data of the 6-bit print data are assigned to nozzle 1, 5, 22, 23, 23, 36 and 38, respectively. Likewise, the print data is assigned at other different timings.

It suffices to measure the shift characteristic of each nozzle in the discharge inspection process during the manufacturing process of the printhead. Based on the measurement result, the block number is written in the memory.

The conventional printing timing will be explained again. As is apparent from FIG. 6, 48 nozzles are periodically assigned to respective blocks such that six nozzles having nozzle numbers 1, 9, 17, 25, 33, and 41 belong to the 0th block, and six nozzles having nozzle numbers 2, 10, 18, 26, 34, and 42 belong to the first block. In contrast, the timing adjustment circuit 607 according to the first embodiment reads a value stored in the printhead, and determines a driving block based on the read value. In the above example, 48 nozzles are assigned to eight blocks such that six nozzles having nozzle numbers 13, 21, 24, 43, 45, and 46 belong to the 0th block, and nozzles having nozzle numbers 8, 11, 31, 32, 35, and 40 belong to the first block. The block is determined based on a block number stored in the memory of the printhead.

According to the above-described embodiment, upon time-divisionally driving the nozzles (heaters) of the printhead, the block can be selected based on head-specific information determined based on the discharge characteristics of the printhead. Since the ink discharge timing of each nozzle can be determined in consideration of the discharge characteristics of the printhead, the printing position can be corrected in consideration of the discharge characteristics of the printhead.

Second Embodiment

In the first embodiment, the printing apparatus corrects the printing position (ink droplet attach position) based on the adjustment result of only the printhead. The second embodiment will explain correction of the printing position by further taking into account the fact that a shift of the printing position changes depending on the characteristics of the printing apparatus, for example, variations of the voltage and capacity of the heater driving power supply and a change over time.

Figure 5:
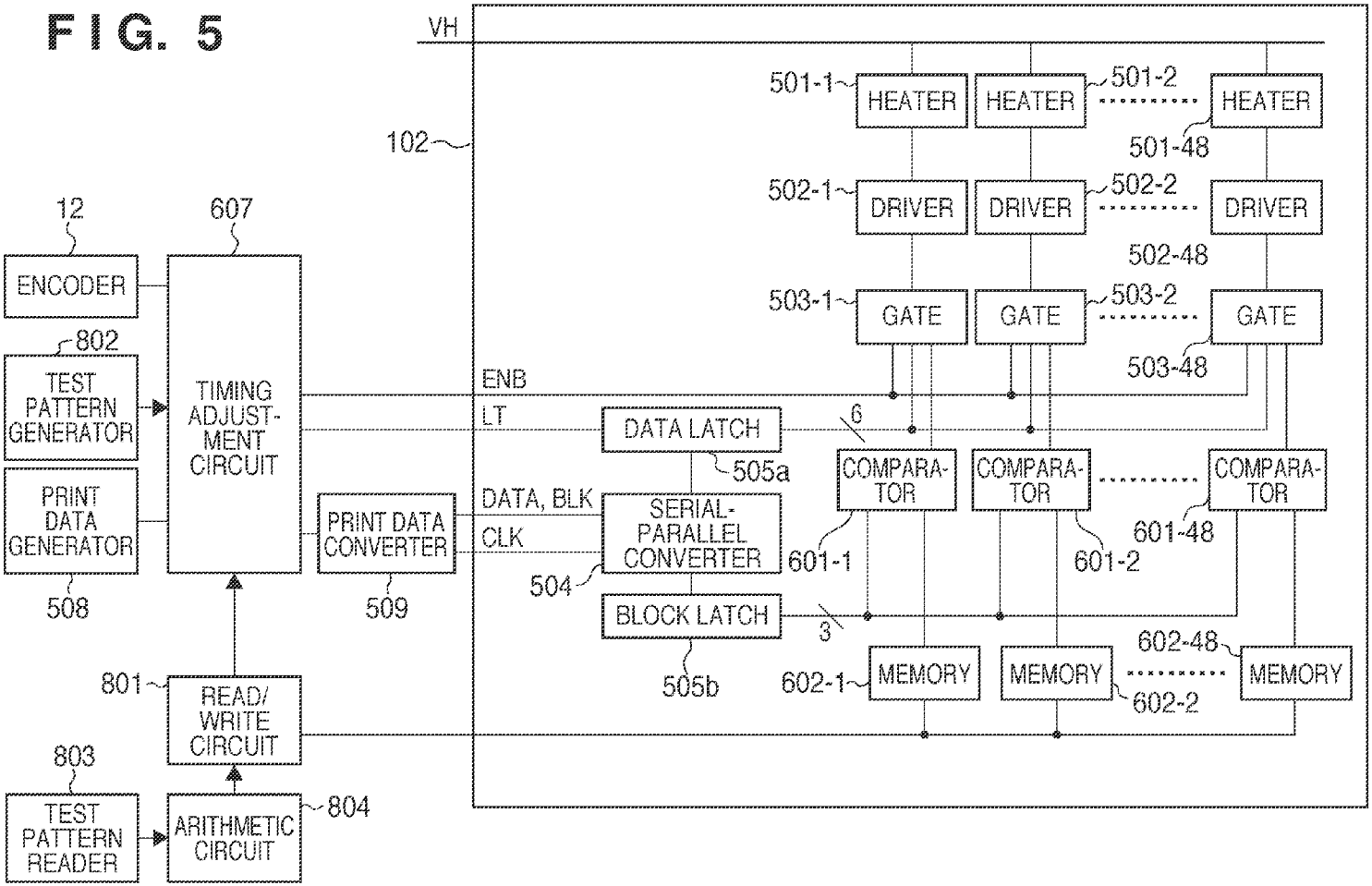
FIG. 5 is a block diagram showing the arrangement of a printhead and that of a control circuit in a printing apparatus concerning ink discharge according to the second embodiment.

FIG. 5 is a block diagram showing the circuit arrangement of a printhead and the arrangement of the print data generator of a printing apparatus according to the second embodiment. In FIG. 5, the same reference numerals as those in the first embodiment and conventional arrangement shown in FIGS. 3 and 7 denote the same parts, and a description thereof will not be repeated. Only an arrangement and operation unique to the second embodiment will be described.

The memory of the printhead according to the second embodiment is, for example, a rewritable memory such as an EEPROM. To cope with this memory, the printing apparatus adopts a read/write circuit 801, instead of the read-only circuit 603 in the first embodiment. The read/write circuit 801 can read out the value of the block number of each nozzle that is stored in the memory of a printhead 102, or write a new value into the memory. When measuring the shift amount of the printing position of each nozzle, a block number (block number changes periodically from 0 to 7) as described in the prior art is written.

The printing apparatus according to the second embodiment includes a test pattern generator 802, and can print a test pattern for positional shift amount measurement in the test print operation mode. At this time, a test pattern reader 803 such as a scanner reads at high precision the test pattern printed on a printing medium. An arithmetic circuit 804 such as a CPU processes the reading result, and determines a block number appropriate for each nozzle. Finally, the memory of the printhead is rewritten with the determined value.

According to the above-described embodiment, even though a mounted printhead is not replaced with a new one, the printing apparatus prints and reads a test pattern, and processes the reading result. Thus, the block number can be rewritten into an optimum one. This allows correcting the printing position in consideration of variations of the voltage and capacity of the heater driving power supply of the printing apparatus and a change over time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-245930, filed Oct. 26, 2009, which is hereby incorporated by reference herein in its entirety.

What is claimed is:

1. An inkjet printhead used to divide a plurality of heaters into a plurality of blocks, time-divisionally drive the heaters for the respective blocks, and print on a printing medium, the printhead comprising:

a serial-parallel converter which receives print data signals and block selection signals serially transferred from a printing apparatus;

a latch which latches the block selection signals;

a plurality of memories which correspond to the respective heaters and store block numbers for driving the respective heaters according to time-divisional driving;

a plurality of comparators which are arranged in correspondence with the respective heaters, receive the block selection signals latched by said latch and the block numbers stored in said plurality of memories, and compare values of the block selection signals and values of the block numbers; and a plurality of drivers which are arranged in correspondence with the respective heaters, and drive the respective heaters in accordance with comparison results of said plurality of comparators.

2. The inkjet printhead according to claim 1, wherein the memories are rewritable memories.

3. The inkjet printhead according to claim 1, wherein the block numbers stored in said plurality of memories are determined based on discharge characteristics measured in a discharge inspection process during a manufacturing process of the inkjet printhead.

4. A printing apparatus, to which an inkjet printhead according to claim 1 is mounted, for printing by discharging ink droplets from the inkjet printhead, the apparatus comprising:

a read-only circuit which reads out block numbers corresponding to the respective heaters from the plurality of memories;

a print data generator which generates print data signals and block selection signals to be supplied to the inkjet printhead; and a timing adjustment circuit which adjusts transfer timings of the print data signals and block selection signals to the inkjet printhead, based on the block numbers read out by said read-only circuit.

5. The apparatus according to claim 4, further comprising:

a test pattern generator which generates a test pattern;

a processing unit which processes a result obtained by reading, by a reader, the test pattern that is generated by said test pattern generator and printed on a printing medium by the inkjet printhead; and a write circuit which transfers, to the inkjet printhead, the block numbers which are obtained by said processing unit and correspond to the respective heaters, and writes the block numbers in the plurality of memories.

6. An inkjet printhead used to print on a printing medium by driving a plurality of heaters at one of a first timing and second timing, the printhead comprising:

a serial-parallel converter which receives print data signals, a first timing signal and a second timing signal serially transferred from a printing apparatus;

a latch which latches the first and second timing signals;

a plurality of memories which correspond to the respective heaters and store information on driving timings assigned to the respective heaters for driving the respective heaters;

a plurality of comparators which are arranged in correspondence with the respective heaters, receive the first and second timing signals latched by said latch and the information stored in said plurality of memories, and compare values of the first and second timing signals and the information; and a plurality of drivers which are arranged in correspondence with the respective heaters, and drive the respective heaters in accordance with comparison results of said plurality of comparators.

* * * * *